US007812270B2

(12) United States Patent
Tan et al.

(10) Patent No.: US 7,812,270 B2
(45) Date of Patent: Oct. 12, 2010

(54) MULTI-DIRECTIONAL DETECT SWITCH

(75) Inventors: Shi-Jie Tan, ShenZhen (CN); Yusho Nakase, Yokohama (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 702 days.

(21) Appl. No.: 11/879,375

(22) Filed: Jul. 16, 2007

(65) Prior Publication Data

US 2008/0014777 A1 Jan. 17, 2008

(51) Int. Cl.
*H01H 9/00* (2006.01)

(52) U.S. Cl. ..... 200/4; 200/6 A

(58) Field of Classification Search ..... 200/4, 200/6 A, 406, 5 A, 6 R, 7, 17 R, 407, 513, 200/557, 553; 439/188, 164
See application file for complete search history.

(56) References Cited

U.S. PATENT DOCUMENTS 2,849,549 A * 8/1958 Elliott ..... 200/6 A
6,399,904 B1 * 6/2002 Mimata ..... 200/6 A
6,586,690 B2 7/2003 Shimomura et al.
6,809,274 B2 * 10/2004 Takeuchi et al. ..... 200/6 A
6,906,269 B2 * 6/2005 Nishimura et al. ..... 200/4
7,102,088 B2 * 9/2006 Tan et al. ..... 200/6 A
7,297,883 B2 * 11/2007 Rochon et al. ..... 200/5 R

* cited by examiner

*Primary Examiner*—Edwin A. Leon
(74) *Attorney, Agent, or Firm*—Ming Chieh Chang; Wei Te Chung; Andrew C. Cheng

(57) ABSTRACT

A multi-directional detect switch (100) includes an insulative housing (5), a number of fixed terminals (4) embedded in the insulative housing, a moveable contact (2), and an actuator (1) positioned on the moveable contact. The fixed terminals include a pair of fixed grounding terminals (44) and a number of fixed periphery terminals (411-414). The moveable contact contacts with the fixed grounding terminal and has a number of periphery beams (21). When the actuator is operated obliquely, one or two periphery beams of the moveable contact is depressed by the actuator for contacting with corresponding one or two fixed periphery terminals, to thereby electrically connect the fixed periphery terminals with the fixed grounding terminal.

17 Claims, 4 Drawing Sheets

MULTI-DIRECTIONAL DETECT SWITCH

BACKGROUND OF THE INVENTION

1. Field of the Invention

The present invention relates to a multi-directional detect switch, and particularly to a detect switch used in a mobile phone or the likes. The detect switch is adapted for electrically connecting with selected fixed terminals via a multi-directional operation.

2. Description of Related Art

A conventional multi-directional detect switch is disclosed in U.S. Pat. No. 6,586,690 issued on Jul. 1, 2003. The detect switch comprises an insulative housing, a fixed central terminal and a fixed common terminal mounted in the insulative housing by insert molding, a dome sheet having a central portion positioned above the fixed central terminal and a periphery portion contacting with the fixed common terminal, four fixed contacts, a moveable contact located between the dome sheet and the fixed contacts, and a cover having a pair of grounding portions. The detect switch comprises a button integrated with the moveable contact as a whole, via a multi-dimensional neck portion connecting the button to the moveable contact. When the button is actuated obliquely, the central portion of the dome sheet comes to contact with the fixed central terminal, and the moveable contact comes to contact with corresponding fixed contact and the cover. The fixed central terminal, the fixed common terminal and the corresponding fixed contact are electrically connected.

As described above, the grounding portions are formed on the cover and would be electrically connected to the moveable contact when the button is operated obliquely. Therefore, the detect switch could not get a reliable connection between the moveable contact and the grounding portions, and thereby could not acquire a good ESD (electrostatic discharge) performance.

Additionally, it is hard to manufacture the moveable contact and the button together as a whole. Furthermore, the multi-dimensional neck portion does not enable the button to have a smooth multi-directional operation.

Hence, an improved multi-directional switch is required to overcome the above-mentioned disadvantages of the related art.

SUMMARY OF THE INVENTION

A primary object of the present invention is to provide a multi-directional detect switch having a good ESD performance and easy to be manufactured.

To achieve the aforementioned object, a multi-directional detect switch comprises an insulative housing, a plurality of fixed terminals embedded in the insulative housing, a moveable contact, and an actuator positioned on the moveable contact. The fixed terminals comprise a pair of fixed grounding terminals for grounding and a plurality of fixed periphery terminals. The moveable contact keeps in contact with the fixed grounding terminal and has a plurality of periphery beams separated from corresponding fixed periphery terminals. When the actuator is operated obliquely, one or two periphery beams of the moveable contact are depressed by the actuator for correspondingly contacting with one or two fixed periphery terminals, to thereby electrically connect the fixed periphery terminals with the fixed grounding terminal.

Either in a normal state or operating the actuaor, the moveable contact keeps in contact with the fixed grounding terminal, to thereby achieve a good ESD performance. Further more, it is easy to manufacture the moveable contact and the actuator into two separated ones.

Other objects, advantages and novel features of the invention will become more apparent from the following detailed description of a preferred embodiment when taken in conjunction with the accompanying drawings.

DETAILED DESCRIPTION OF THE INVENTION

Figure 1:
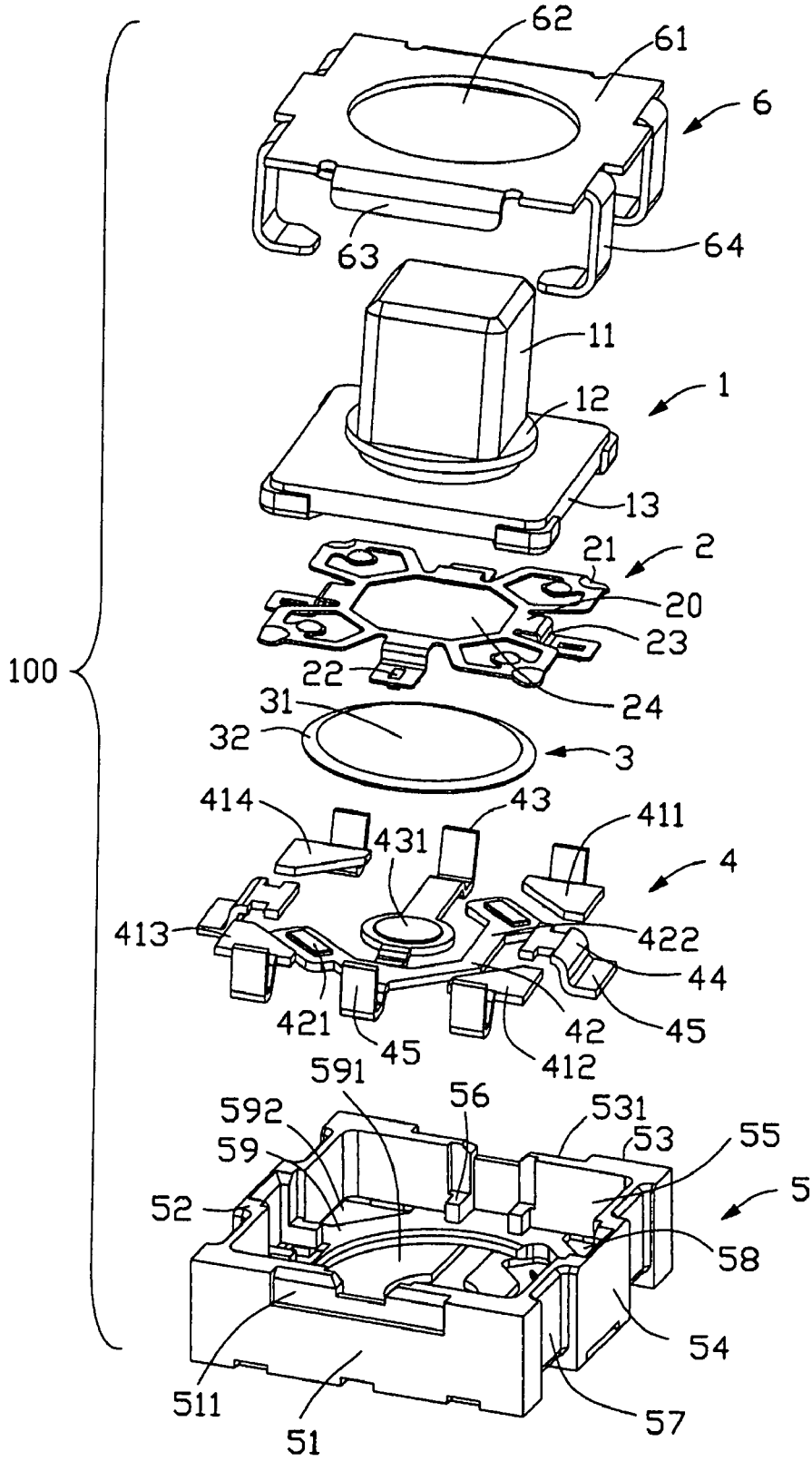
FIG. 1 is an exploded perspective view of a multi-directional detect switch in accordance with the present invention.
Figure 2:
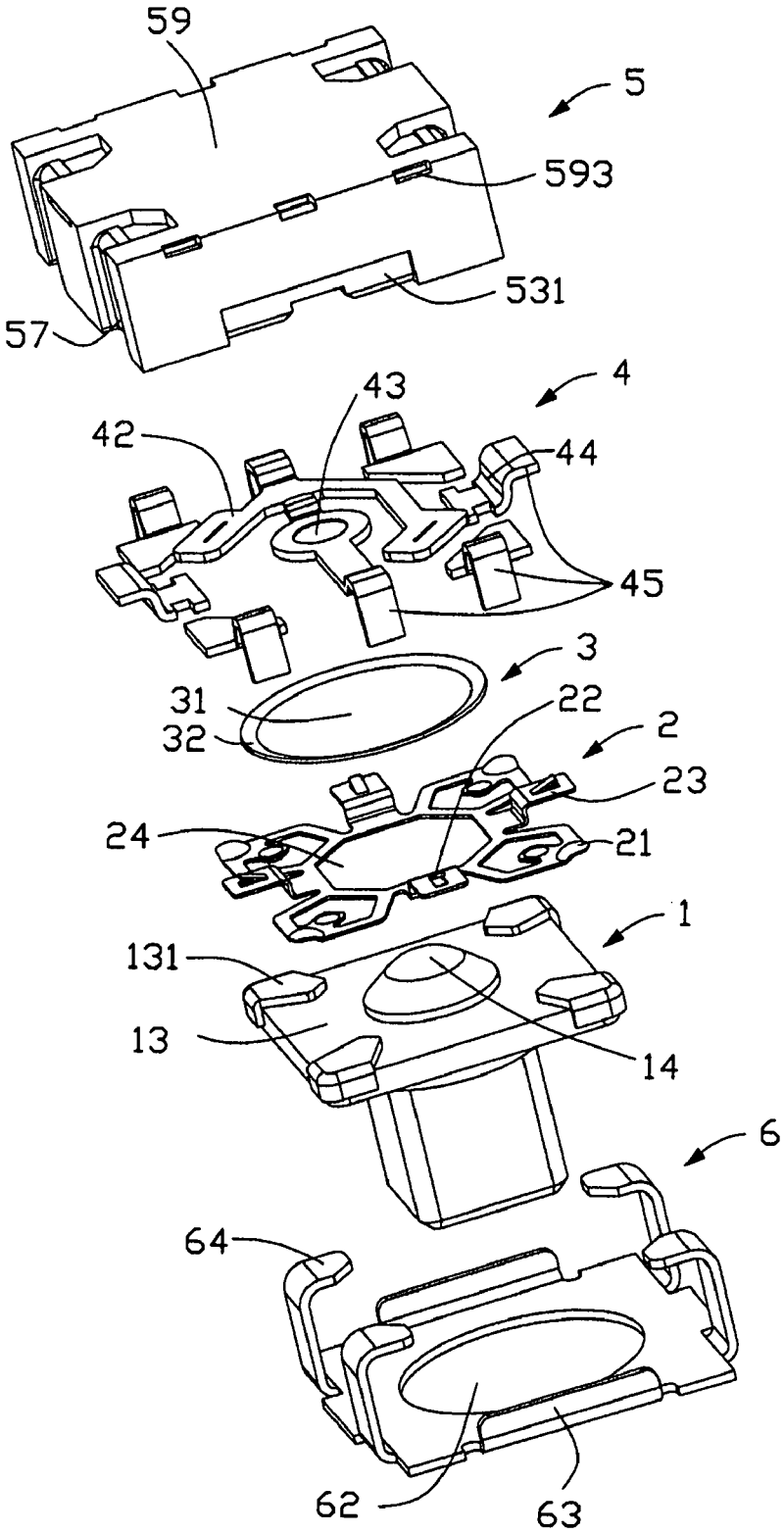
FIG. 2 is an exploded perspective view of the multi-directional detect switch as shown in FIG. 1, taken from another aspect.

Reference will now be made to the drawing figures to describe the present invention in detail. Referring to FIGS. 1-2, a multi-directional detect switch 100 in accordance with the preferred embodiment of the present invention comprises an insulative housing 5, a plurality of fixed terminals 4, a dome sheet 3, a moveable contact 2, an actuator 1 and a cover 6.

The insulative housing 5 is a substantially rectangular case, comprising a bottom wall 59, a primary wall 51, a pair of side walls 52, 54 and a combined wall 53 upstanding from the bottom wall 59 to thereby define a cavity 55 thereamong. Each wall 51-54 has a pair of tubers 56 protruding inwardly from a lower portion of an inner surface thereof. The pairs of tubers 56 are then arranged around the cavity 55. The primary wall 51 and the combined wall 53 respectively have an engaging groove 511, 531 extending along a transverse direction defined on outer surfaces thereof. Each side wall 52, 54 has an insertion recess 58 defined in a middle portion of an inner surface thereof, and a pair of engaging recesses 57 defined at an outer surface thereof. The insertion recesses 58 and the engaging recesses 57 extend in a top-to-bottom direction. The bottom wall 59 has a circular first depressions 591 defined in a central portion thereof and four second depressions 592 defined at four corner portions thereof. A plurality of slots 593 defined along four side edges of the bottom wall 59 and extend throughout the bottom wall 59.

The plurality of fixed terminals 4 comprise a fixed central terminal 43 having a central contact portion 431, a fixed common terminal 42 provided with a pair of periphery contact portions 421 and a connection portion 422 connecting the pair of periphery contact portions 421 together, and a first through fourth fixed periphery terminals 411-414. The fixed terminals 4 are respectively formed with a tail portion 45 for soldering onto a circuit board (not shown).

The dome sheet 3 comprises a central portion 31 formed at a topmost thereof and an annular periphery portion 32 encircling around the central portion 31.

The movable contact 2 comprises a body portion 20, a first extension hole 24 defined in a central portion thereof, four periphery beams 21 projecting radially from the body portion 22, a pair of Z-shaped contact beams 23 and a pair of Z-shaped support beams 22 respectively formed between a pair of adjacent periphery beams 21.

The actuator 1 comprises a rectangular base portion 13, a protrusion 14 projecting downwardly from a bottom face of the base portion 13, an upstanding button 11, and a circular neck portion 12 connecting the button 11 to the base portion 13. The base portion 13 has four engaging portions 131 formed at four corner portions of the bottom face thereof for engaging with the periphery beams 21 of the moveable contact 2.

The cover 6 has a substantially rectangular top wall 61, a circular second extension hole 62 defined in a central portion of the top wall 61, a pair of engaging protrusions 63 formed at opposite edges of the top wall 61, and two pairs of L-shaped engaging beams 64 respectively extending downwardly from another opposite edges of the top wall 61.

Figure 3:
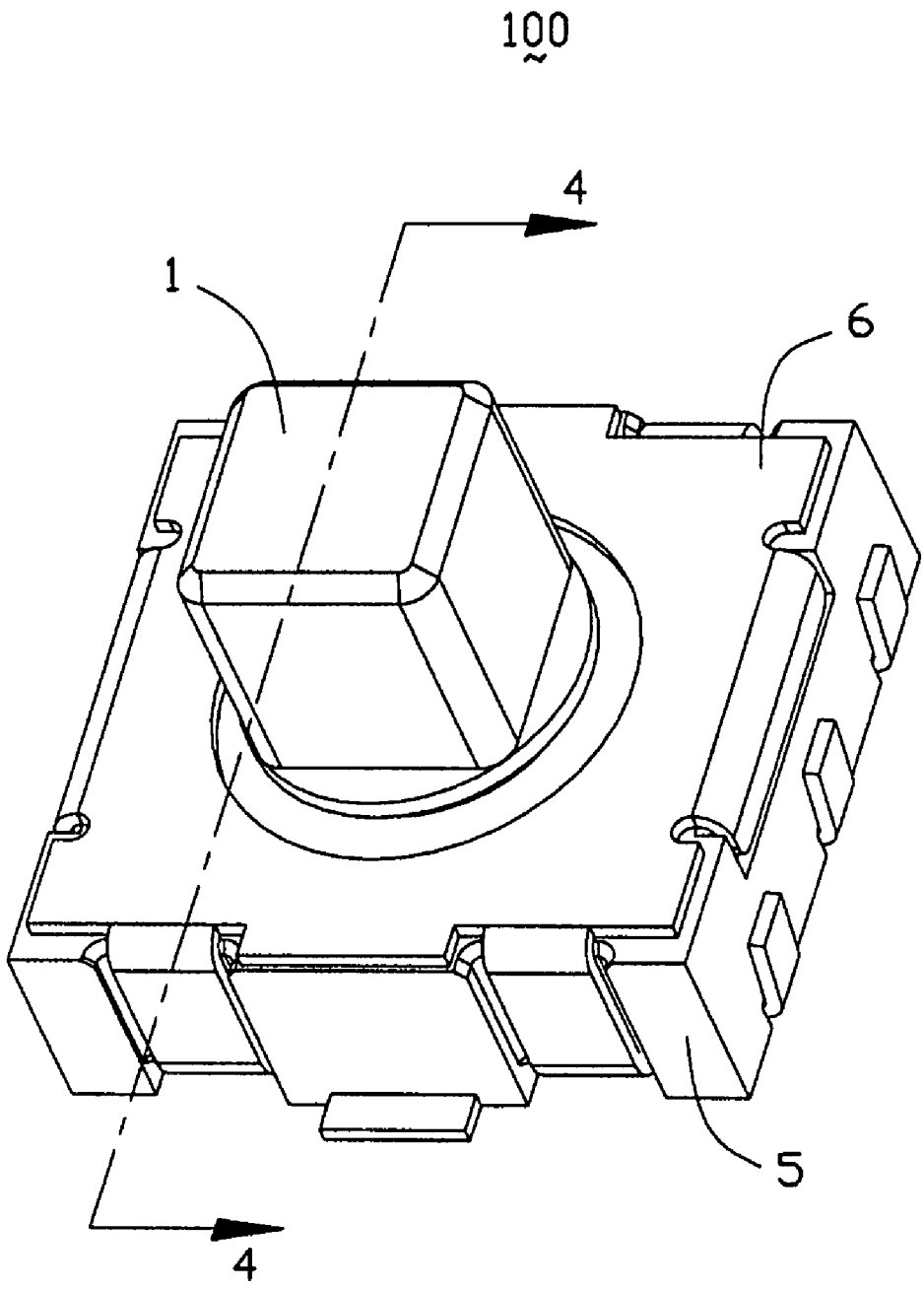
FIG. 3 is an assembled perspective view of the multi-directional detect switch as shown in FIG. 1.

Referring to FIGS. 1-3, in assembly of the detect switch 100, the plurality of fixed terminals 4 are firstly mounted in the insulative housing 5 by insert molding, with the tail portions 45 thereof extending outside of the insulative housing 5 from corresponding slots 593. The central contact portion 431 of the fixed central terminal 43 is disposed in a center of the bottom wall 59. The connection portion 422 of the fixed common terminal 42 partially surrounds the central contact portion 431, with the central contact portion 431 disposed between the pair of periphery contact portions 421. The first through fourth fixed periphery terminals 411-414 are retained in corresponding second depressions 592. The fixed grounding terminals 44 are mounted adjacent to the side walls 52, 54, with the tail portions 45 thereof extending outwardly for grounding.

The dome sheet 3 is then retained in the first depression 591 of the insulative housing 5, with the periphery portion 32 in contact with the pair of periphery contact portions 421 of the fixed common terminal 42, and with the central portion 31 positioned a certain distance above the central contact portion 431 of the fixed central terminal 43.

The moveable contact 2 is then supported on the bottom wall 59 by the pair of support beams 22 and the pair of contact beams 23. The support beams 22 are respectively confined between a pair of tubers 56 of the primary wall 51 and a pair of tubers 56 of the combined wall 53. The contact beams 23 are partially inserted in the insertion recesses 58 and are respectively confined between a pair of tubers 56 of the side walls 52, 54 for contacting with corresponding fixed grounding terminals 44. The periphery beams 21 of the moveable contact 2 are positioned a certain distance above the first through fourth fixed periphery terminals 411-414.

The actuator 1 is then mounted on the moveable contact 2, with the engaging portions 131 resisted against by the periphery beams 21 of the moveable contact 2. The protrusion 14 of the actuator 1 extends downwardly through the first extension hole 24 of the moveable contact 2 for touching the central portion 31 of the dome sheet 3.

The cover 6 is finally attached to a top portion of the insulative housing 5, with the button 11 of the actuator 1 extending upwardly from the extension hole 62. The pair of engaging protrusions 63 and the pair of engaging beams 64 are respectively engaging with the engaging grooves 511, 531 and the engaging recesses 57 of the insulative housing 5. The detect switch 100 is assembled as a whole finally. The detect switch 100 is grounded in a normal state before it is operated, due to an engagement between the contact beams 23 and the fixed grounding terminals 44.

Figure 4:
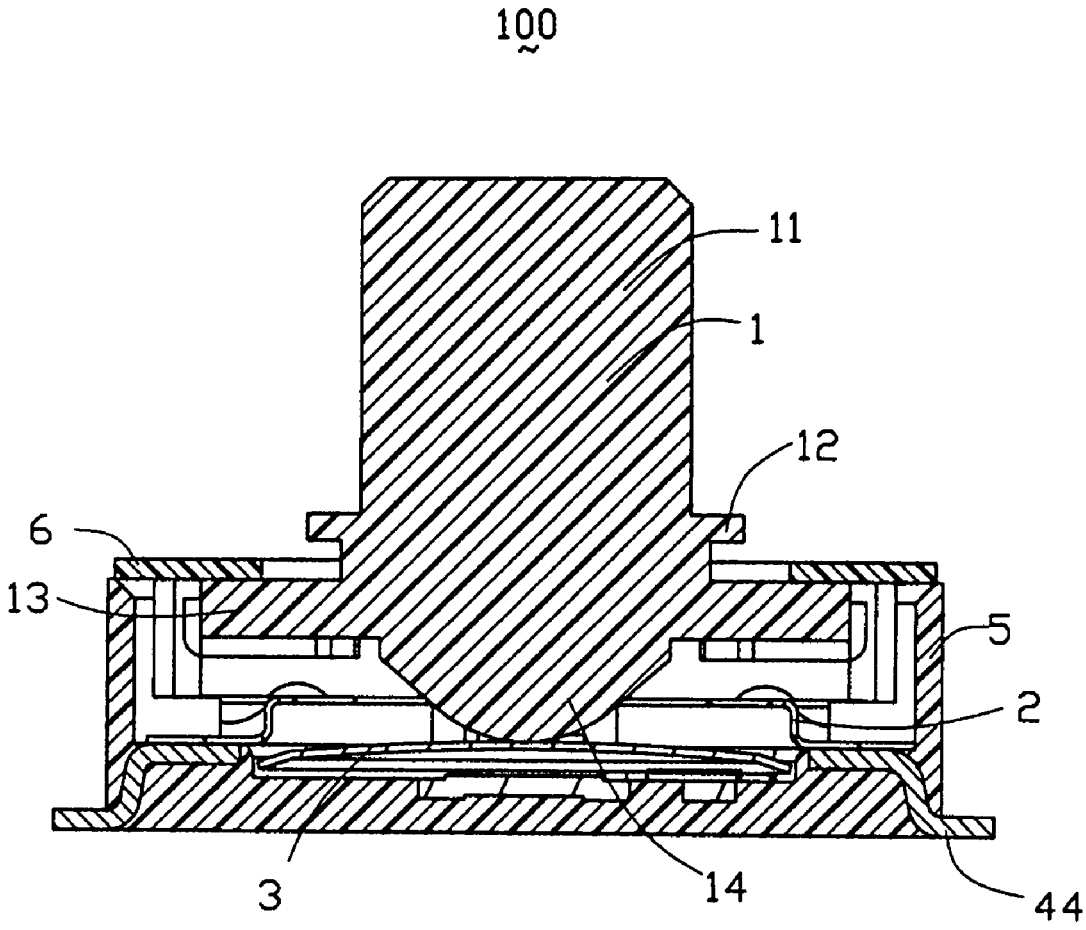
FIG. 4 is a cross-sectional view taken along line 4-4 in FIG. 3.

Referring to FIG. 4, in operation, upon exerting external forces onto the button 11 of the actuator 1, the button 1 could be operated downwardly or obliquely. When the button 11 of the actuator 1 is pushed downwardly, the central portion 31 of the dome sheet 3 is depressed by the protrusion 14 for contacting with the central contact portion 431 of the fixed central terminal 43. The fixed common terminal 42 in contact with the periphery portion 32 of the dome sheet 3 is electrically connected with the fixed central terminal 43.

The button 11 of the actuator 1 could be operated obliquely toward eight directions. When the button 11 is manipulated transversely toward the side wall 54, a pair of periphery beams 21 of the moveable contact 2 are depressed by corresponding engaging portions 131 of the actuator 1 for contacting with the first and the second fixed periphery terminals 411, 412. The first, second fixed periphery terminals 411, 412 and the fixed grounding terminals 44 are electrically connected, since the contact beams 23 still keep in contact with the fixed grounding terminals 44. Simultaneously, the central portion 31 of the dome sheet 3 is depressed for contacting with the central contact portion 431 to thereby electrically connect the fixed central terminal 43 with the fixed common terminal 42.

Correspondingly, when the button 11 is manipulated toward another three walls 51-53, corresponding two neighboring fixed periphery terminals are electrically connected to the fixed grounding terminals 44. Simultaneously, the fixed central terminal 43 is electrically connected with the fixed common terminal 42.

When the button 11 is manipulated toward the corner portion adjacent to the combined wall 53 and the side wall 54, one periphery beam 21 of the moveable contact 2 is depressed by corresponding engaging portion 131 of the actuator 1 for contacting with the first fixed periphery terminal 411. The first fixed periphery terminal 411 and the fixed grounding terminals 44 are electrically connected, since the contact beams 23 still keep in contact with the fixed grounding terminals 44. Simultaneously, the fixed central terminal 43 is electrically connected with the fixed common terminal 42.

Correspondingly, when the button 11 is manipulated toward another three corner portions of the bottom wall 59, one corresponding periphery terminal 42-44 is electrically connected with the fixed grounding terminal 44. Simultaneously, the fixed central terminal 43 is electrically connected with the fixed common terminal 42.

During operation, the circular neck portion 12 would make a smooth movement of the button 11 around along eight directions.

When the external forces are removed, the detect switch 100 would restores itself to the normal state due to a resilient force from a deformation of the dome sheet 3 and the button 11.

Understandably, when the fixed central terminal 43 and the fixed common terminal 42 are not needed in the application, the dome 3 could be removed from the insulative housing 5. The moveable contact 2 is supported by the beams 22, 23 and keeps in contact with the fixed grounding terminals 44. The actuator 1 is operated obliquely for urging one or two neighboring periphery beams 21 of the moveable contact 2 to contact with corresponding one or two neighboring fixed periphery terminals 411-414.

However, the disclosure is illustrative only, changes may be made in detail, especially in matter of shape, size, and arrangement of parts within the principles of the invention.

What is claimed is:

1. A multi-directional detect switch, comprising:

an insulative housing defining a cavity;

a plurality of fixed terminals comprising a fixed grounding terminal and a plurality of fixed periphery terminals embedded in the insulative housing;

a moveable contact contacting with said fixed grounding terminal and having a plurality of periphery beams separated from corresponding fixed periphery terminals; and an actuator being manipulatable obliquely to press at least one of the periphery beams of the moveable contact to contact with corresponding one of the fixed periphery terminals, thereby electrically connecting said fixed periphery terminal with the fixed grounding terminal.

2. The multi-directional detect switch as claimed in claim 1, wherein said fixed terminals comprise a fixed common terminal having a pair of periphery contact portions, and a fixed central terminal having a central contact portion disposed between the pair of periphery contact portions.

3. The multi-directional detect switch as claimed in claim 2, further comprising a dome sheet having a periphery portion in contact with the periphery contact portions and a central portion contactable with the central contact portion to electrically connect the fixed central terminal with the fixed common terminal when the dome sheet is depressed by the actuator.

4. The multi-directional detect switch as claimed in claim 3, wherein said moveable contact is formed with a pair of contact beams contactable with the fixed grounding terminal, and a pair of support beams upholding the moveable contact.

5. The multi-directional detect switch as claimed in claim 4, wherein said cavity has a plurality of pairs of tubers formed therearound for confining the contact beams and the support beams.

6. The multi-directional detect switch as claimed in claim 4, wherein said moveable contact defines a first extension hole, and wherein said actuator is provided with a protrusion extending downwardly through the first extension hole for touching the central portion of the dome sheet.

7. The multi-directional detect switch as claimed in claim 6, wherein said actuator comprises a base portion, an upstanding button adapted for being manipulated toward different directions, and a neck portion connecting the button to the base portion.

8. The multi-directional detect switch as claimed in claim 7, wherein said neck portion is formed as a circular configuration for manipulating the button along different directions smoothly.

9. The multi-directional detect switch as claimed in claim 7, wherein said base portion has a plurality of engaging portions formed at a bottom surface thereof for contacting with the fixed periphery terminals.

10. The multi-directional detect switch as claimed in claim 1, wherein said insulative housing comprises a bottom wall and a plurality of walls upstanding from the bottom wall to thereby define the cavity therebetween.

11. The multi-directional detect switch as claimed in claim 10, further comprising a cover attached to a top portion of the insulative housing and defining thereon a second extension hole for partially extension of the actuator.

12. The multi-directional detect switch as claimed in claim 11, wherein a pair of opposite walls of the plurality of walls define thereon a pair of engaging grooves for engaging with a pair of engaging protrusions formed on the cover, and wherein another pair of opposite walls of the plurality of walls define thereon two pairs of engaging recesses for engaging with two pairs of engaging beams formed on the cover.

13. The multi-directional detect switch as claimed in claim 10, wherein each fixed terminal has a tail portion, said bottom wall having a plurality of slots defined along side edges thereof for extension of the tail portions of the fixed terminals.

14. A multi-directional detect switch, comprising:

an insulative housing defining a cavity;

a plurality of fixed terminals comprising a plurality of fixed periphery terminals and a fixed center terminal embedded in the insulative housing;

a moveable contact having a plurality of periphery beams separated from corresponding fixed periphery terminals and defining a center opening; and a metal dome located below the moveable contact and essentially vertically aligned with the fixed center terminal; wherein said actuator defining a downward center protrusion vertically aligned with the fixed center terminal, and a plurality of downward periphery protrusions vertically aligned with periphery beams, respectively, so that the actuator is manipulatable obliquely to press at least one of the periphery beams of the moveable contact to contact with corresponding one of the fixed periphery terminals or downwardly to press the metal dome to contact with the fixed center terminal.

15. The switch as claimed in claim 14, wherein the moveable contact defines a mounting leg directly seated upon the housing for retaining the moveable terminal in the housing.

16. The switch as claimed in claim 14, wherein the moveable contact defines a mounting leg directly seated upon a fixed grounding contact to form an electrical circuit loop when one of the periphery beams contacts the corresponding fixed periphery terminal.

17. The switch as claimed in claim 14 wherein a peripheral region of the metal dome constantly contacts a fixed grounding terminal.

* * * * *